US007469109B2

(12) United States Patent
Shibuya

(10) Patent No.: US 7,469,109 B2
(45) Date of Patent: Dec. 23, 2008

(54) IMAGE FORMING APPARATUS WITH RESIDUAL TONER TRANSFER PREVENTION FEATURE

(75) Inventor: Kenichi Shibuya, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 156 days.

(21) Appl. No.: 11/531,053

(22) Filed: Sep. 12, 2006

(65) Prior Publication Data

US 2007/0059000 A1 Mar. 15, 2007

(30) Foreign Application Priority Data

Sep. 13, 2005 (JP) ..... 2005-265419

(51) Int. Cl.
*G03G 15/02* (2006.01)

(52) U.S. Cl. ..... 399/50

(58) Field of Classification Search ..... 399/43, 399/44, 50, 129, 149, 150
See application file for complete search history.

(56) References Cited

U.S. PATENT DOCUMENTS 6,532,347 B2 3/2003 Watanabe et al. ..... 399/50
6,640,063 B2 * 10/2003 Adachi et al. ..... 399/50
2004/0013438 A1 * 1/2004 Watanabe et al. ..... 399/50
2004/0086297 A1 * 5/2004 Watanabe ..... 399/129
2004/0131385 A1 * 7/2004 Yoshikawa ..... 399/129

FOREIGN PATENT DOCUMENTS

JP 2001-201921 7/2001

* cited by examiner

*Primary Examiner*—Sandra L Brase
(74) *Attorney, Agent, or Firm*—Fitzpatrick, Cella, Harper & Scinto

(57) ABSTRACT

A printer 20 includes a photosensitive drum 1, a charge roller 2 for electrically charging the photosensitive drum 1, a developing device 4 for developing an electrostatic latent image on the photosensitive drum 1 into a toner image, a transfer roller 5 for transferring the toner image onto a recording material, and a transfer residual toner charging member 8 for electrically charging toner remaining on the photosensitive drum 1. In the printer, a DC voltage substantially identical to a potential on the photosensitive drum 1 before the photosensitive drum 1 reaches the charge roller 2 is applied to the charge roller 2 together with application of a voltage of an identical polarity to a charge polarity of toner to the transfer residual toner charging member 8 during a current measuring operation for measuring a value of AC current passing through the charge roller 2, in order to set a condition of a voltage to be applied to the charge roller 2 during image formation, by applying an AC voltage to the charge roller 2.

5 Claims, 11 Drawing Sheets

IMAGE FORMING APPARATUS WITH RESIDUAL TONER TRANSFER PREVENTION FEATURE

FIELD OF THE INVENTION AND RELATED ART

The present invention relates to an image forming apparatus for recovering residual toner remaining on an image bearing member by a developing device.

An image forming apparatus of a transfer type wherein a toner image is formed on a recording material according to electrophotography has been conventionally used. Examples of the image forming apparatus may include a copying machine, a printer, a facsimile apparatus, multiple function processing machines of these, and the like.

The image forming apparatus is constituted by a photosensitive member, a charging device, an exposure device, a developing device, a transfer device, a cleaner, a fixing device, etc. The image forming apparatus forms a toner image on a recording material by the following operation.

First, a photosensitive member as an image bearing member which is generally of a rotation drum-type is electrically charged uniformly by the charging device to a predetermined polarity and a predetermined potential (charging step), and the charged photosensitive member is exposed to light by the exposure device to form an electrostatic latent image on the photosensitive member (exposure step). The electrostatic latent image is developed with toner as a developer to form a toner image as a visualized image (developing step), and the toner image is transferred from the photosensitive member onto a recording material (transfer step). Thereafter, the toner image is fixed on the recording material under application of heat and pressure by the fixing device (fixing step). Finally, the image forming apparatus discharges the recording material. Transfer residual toner, as residual toner, somewhat remaining on the photosensitive member after the transfer step is removed by a cleaning member (cleaner) for cleaning the surface of the photosensitive member (cleaning step). Thereafter, formation of the toner image is performed again on the photosensitive member. The image forming apparatus repetitively effect the above described image forming process (charging, exposure, developing, transfer, and cleaning) to successively form the toner image on the recording material.

Of the step described above, in the cleaning step, the transfer residual toner removed by the cleaner remains in the cleaner to constitute waste toner. However, it is desirable that there is no waste toner in terms of environmental conservation, effective use of resources, etc.

For this reason, in recent years, many of the image forming apparatuses employ such a cleaner-less scheme that the transfer residual toner remaining on the photosensitive member is removed from the photosensitive member by the developing device without providing the cleaner (simultaneous developing and cleaning) and recovered in the developing device to be subjected to reuse.

The simultaneous developing and cleaning is a method in which transfer residual toner deposited at a non-image portion requiring no developing on the photosensitive member in the developing step of a subsequent electrophotographic process after the (previous) transfer step is recovered in the developing device by a potential difference between a DC voltage applied to the developing device and a surface potential of the photosensitive member.

According to this method, the transfer residual toner is recovered in a developing apparatus and reutilized in development of the electrostatic latent image in a subsequent step or later, so that an amount of waste toner can be considerably decreased. Further, it is also possible to realize less maintenance requirement. Further, the cleaner-less scheme is also effective in reducing the size of the image forming apparatus.

As described above, in the simultaneous developing and cleaning method, the transfer residual toner is recovered in the developing device by the difference between the applied DC voltage to the developing device and the surface potential of the photosensitive member, so that it is possible to recover the transfer residual toner without effecting the exposure step in a subsequent electrophotographic process after the transfer step.

Further, the voltage applied to a contact charging member may only be a DC. However, an oscillating voltage is applied so as to alternately cause discharge toward a positive (+) side and a negative (−) side.

For example, an oscillating voltage including an AC voltage having a peak-to-peak voltage, which is two times or above a charge start voltage when a DC voltage is applied, superposed or biased with a DC voltage (DC effect bias) is applied. As a result, a charging level of the photosensitive member is uniformized, so that it is possible to effect uniform electrical charging.

Herein, a contact charging method in which the oscillation voltage is applied to the charging member to charge the charging member is referred to as an "AC charging method". Further, a contact charging method in which only the DC voltage is applied to charge the charging member is referred to as a "DC charging method".

Compared with the DC charging method, the AC charging method is accompanied with an increased amount of discharge with respect to the photosensitive member, so that an abnormal image has been caused to occur on the photosensitive member due to a resultant discharge product in some cases.

Particularly, in the cleaner-less system with no cleaner as in the present invention, there is no cleaning member for actively wearing the photosensitive member. For this reason, the cleaner-less system is much adversely affected by the discharge product. As a result, such a phenomenon that the transfer residual toner is melted and deposited on the surface of the photosensitive member at a charging portion by the discharge at a contact charging portion is caused to occur.

In order to remedy such a problem, it is necessary to minimize the alternately caused discharge toward the positive side and the negative side by application of a minimum voltage.

Japanese Laid-Open Patent Application (JP-A) 2001-201921 discloses an image forming apparatus as shown in FIG. 4 thereof. The image forming apparatus includes a control circuit for controlling respective values of a DC voltage and a peak-to-peak voltage of AC voltage which are applied to a charging member and a measuring circuit for measuring a value of AC current passing from an AC power supply to the charging member via a photosensitive member.

Here, a discharge start voltage when the DC voltage is applied to the charging member is taken as Vth. During non-image formation, a current value at the time of applying at least one peak-to-peak voltage less than two times (the value of) Vth and current values at the time of applying at least two peak-to-peak voltages not less than two times Vth are measured by the measuring circuit. Then, the control circuit determines a peak-to-peak voltage of AC voltage to be applied to the charging member during image formation on the basis of the measured current values and effects control so that an amount of discharge current of AC is constant (hereinafter referred to as "discharge current control"). As a result, in the image forming apparatus described in JP-A 2001-201921, a minimum amount of discharge current is calculated in real time, so that it is possible to suppress image failure or the like due to the discharge product even when a variation in charging device due to conditions of environment or production is caused to occur.

Further, the image forming apparatus described in JP-A 2001-201921 facilitates recovery in the developing device of the transfer residual toner rotated on the photosensitive member by toner charging means (see FIG. 11). More specifically, in order to electrically charge residual toner after transfer to a normal charge polarity, a voltage of an identical polarity to the normal charge polarity is applied.

However, in the conventional image forming apparatus, the toner charging means also charge the photosensitive member when it charge-controls the transfer residual toner. On the other hand, during the discharge current control, there is also a case where not only toner charged to the normal polarity but also toner charged to a reverse polarity are deposited on the photosensitive member by the rotation of the photosensitive member. For this reason, also during the discharge current control, a voltage is applied to the toner charging means.

As a result, in the case where only an AC voltage is applied during the display current control, a potential difference is caused at a contact portion between the charging member and the photosensitive member charged by the toner charging means. More specifically, on the charging member side where the DC voltage is not applied, an electric field is generated from the photosensitive member side to cause a problem of deposition of toner on the charging member.

SUMMARY OF THE INVENTION

An object of the present invention is to provide an image forming apparatus capable of preventing transfer residual toner on an image bearing member (photosensitive member) from transferring from the image bearing member to an image bearing member charging member by eliminating a potential difference between a charged surface of the image bearing member and the image bearing member charging member during discharge current control.

According to an aspect of the present invention, there is provided an image forming apparatus, comprising:

an image bearing member;

an image bearing member charging member for electrically charging the image bearing member by applying an AC voltage superposed with a DC voltage to the image bearing member;

developing means for forming a toner image, from an electrostatic latent image formed on the image bearing member, simultaneously with recovery of toner remaining on the image bearing member after the toner image on the image bearing member is transferred;

a transfer member for transferring the toner image onto a transfer material;

a toner charging member, located downstream from the transfer member and upstream from the image bearing member charging member in a rotation direction of the image bearing member, for electrically charging the toner on the image bearing member rotated along the toner charging member by applying a voltage of an identical polarity to a charge polarity of the toner; and DC voltage control means for applying to the image bearing member charging member a DC voltage, which is substantially identical to a potential on the image bearing member before reaching the image bearing member charging member, during an operation for measuring a value of AC current passing through the image bearing member charging member, in order to set a condition of voltage to be applied to the image bearing member charging member during image formation, by applying an AC voltage to the image bearing member charging member in a state in which the voltage of the identical polarity to the charge polarity of the toner is applied to the toner charging member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, the present invention will be described move specifically based on embodiments.

Figure 1:
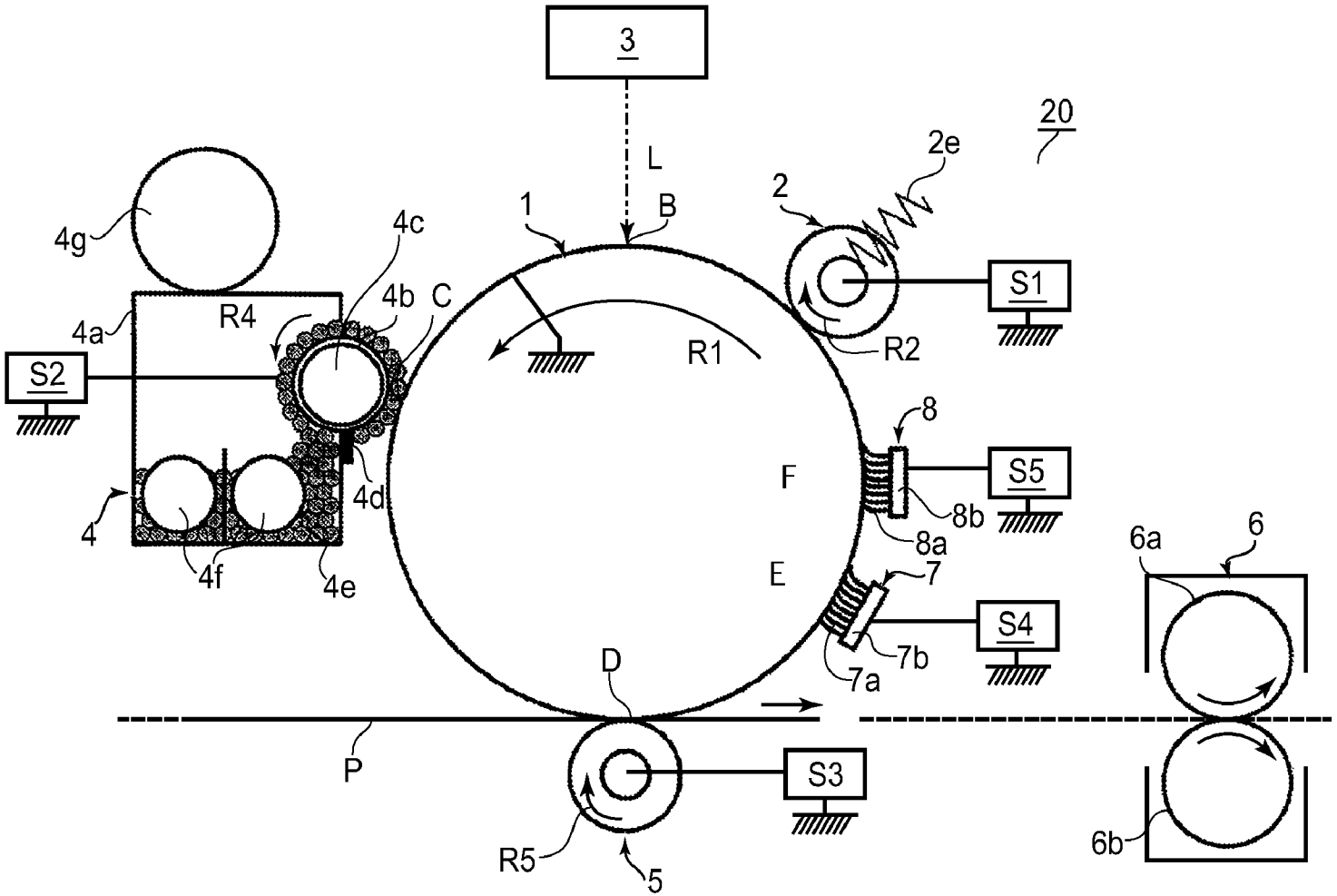
FIG. 1 is a schematic structural view showing a principal portion common to a laser beam printer as an image forming apparatus according to each of embodiments of the present invention.
Figure 2:
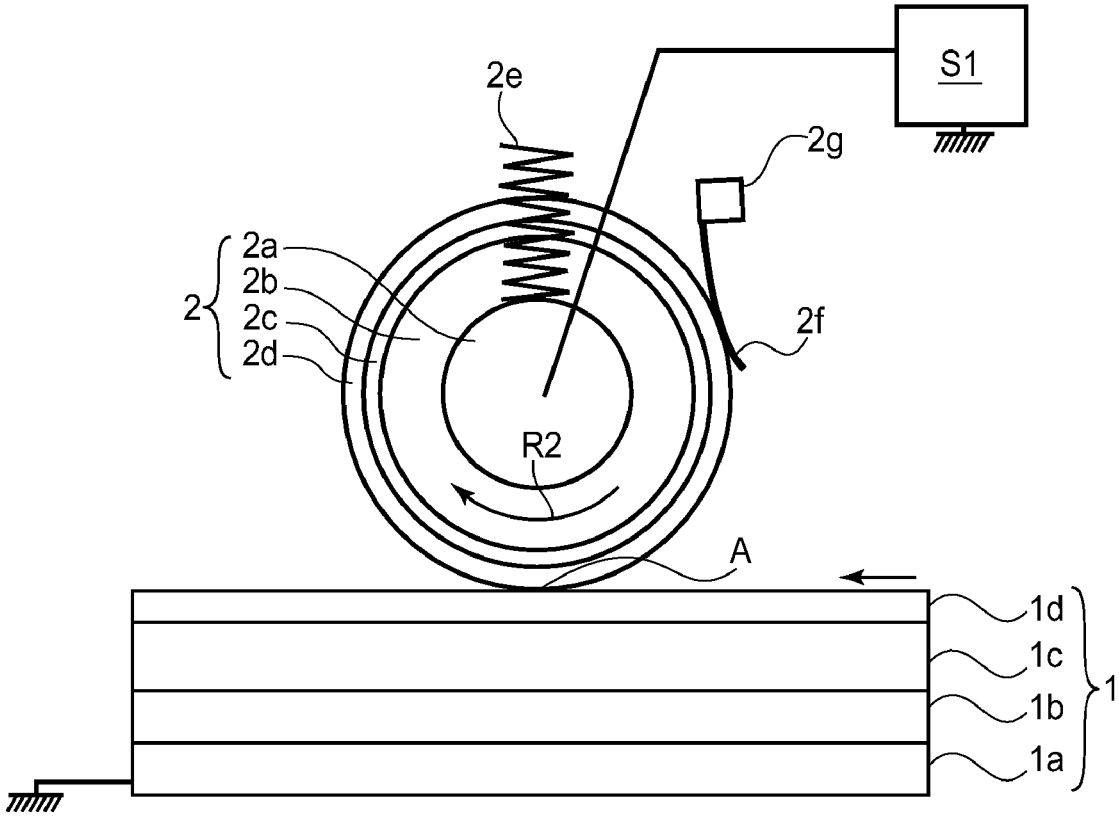
FIG. 2 is a schematic sectional view showing a layer structure of a photosensitive drum and a layer structure of a charge roller which are common to the image forming apparatuses of respective embodiments of the present invention.

FIG. 1 is a schematic structural view showing a common principal portion in image forming apparatuses according to respective embodiments of the present invention. FIG. 2 is a schematic sectional view showing common layer structures of a photosensitive drum and a charge roller in the image forming apparatuses according to respective embodiments of the present invention.

As an electrophotographic image forming apparatus common to the respective embodiments of the present invention, a laser beam printer (hereinafter simply referred to as a "printer") is used. The printer employs such a contact charging method that a rotation drum-type electrophotographic photosensitive member 1 as an image bearing member (hereinafter referred to as a "photosensitive drum") is electrically charged by a charge roller 2 as an image bearing member charging member by bringing the charge roller 2 into contact with the photosensitive drum 1. Incidentally, in the respective embodiments, numerical values are reference values and do not restrict the present invention.

(Printer as image forming apparatus of the First Embodiment)

Referring to FIG. 1, a printer (laser beam printer) 20 includes the photosensitive drum 1 . Along a rotation direction (of an indicated arrow R1) of the photosensitive drum 1, members including the charge roller (also referred to as charger roller) 2 as a contact charging member for the photosensitive drum(image bearing member)1, a developing device 4, a transfer roller 5 as a contact transfer member (transfer means), an auxiliary charging member 7 as an auxiliary charging means, and a transfer residual toner charging member 8 as a toner charging means are disposed.

Further, an exposure device 3 for effecting imagewise exposure is also disposed opposite to the photosensitive drum 1. At a portion downstream from a transfer portion created between the photosensitive drum 1 and the transfer roller 5 in a recording material conveyance direction, a fixing device 6 is disposed.

The photosensitive drum 1 is formed of negatively chargeable organic photoconductor (OPC) in another diameter of 30 mm and is rotationally driven by actuation of drive means (not shown) at a process speed (peripheral speed) of 210 mm/sec in the direction of the indicated arrow R1 (counterclockwise direction in FIG. 1).

The photosensitive drum 1 includes, as shown in FIG. 2, an aluminum cylinder (electroconductive drum support) 1*a*; an undercoat layer 1*b* for suppressing light interference and improving an adhesiveness to an overlying layer, disposed on an outer peripheral surface of the cylinder 1*a*; a photocharge generation layer 1*c* disposed on the undercoat layer 1*b*; and a charge transport layer 1*d* disposed on the photocharge generation layer 1*c*.

The charging roller 2 is rotationally supported by an unshown pair of bearing members, at both end portions of its core metal 2*a*, and is biased against the photosensitive drum 1 by compression coil springs 2*e* so that its peripheral surface is pressed against the peripheral surface of the photosensitive drum 1 at a predetermined pressing force. For this reason, the charging roller 2 is rotated in a direction of an arrow R2 by the rotation of the photoconductive drum 1. The pressure contact portion between the photoconductive drum 1 and charging roller 2 constitutes a charging portion (charging nip) A.

To the core metal 2*a* of the charging roller 2, a charge bias voltage, which satisfies predetermined requirements, is applied from an electrical power source S1. As a result, the peripheral surface of the photosensitive drum 1 is electrically uniformly charged to predetermined polarity and potential level by the contact charging method. In this embodiment, the charge bias voltage applied to the charging roller 2 is an oscillating voltage including a DC (Vdc) voltage superposed or biased with an AC (Vac) voltage. More specifically, it is a combination of DC voltage (Vdc) of −500 V, and AC voltage (Vac), which is 2 kHz and 1.4 kV in frequency and peak-to-peak voltage, respectively, and has a sinusoidal waveform. As a result, the peripheral surface of the photosensitive drum 1 is uniformly charged to −500 V (dark part potential Vd) by the contact charging method.

The charging roller 2 has a length of 320 mm in a longitudinal (lengthwise) direction. The charge roller 2 comprises, as shown in FIG. 2, the aforementioned core metal 2*a* (supporting member), and three layers including an undercoat layer 2*b*, an intermediary layer 2*c*, and a surface layer 2*d*, which are placed in layers on the peripheral surface of the core metal 2*a*, in this order. The undercoat layer 2*b* is a foamed sponge layer for reducing the charging noises. The surface layer 2*d* is a protective layer provided for preventing an occurrence of electrical leak even when the peripheral surface of the photoconductive drum 1 has defects such as pin holes.

More specifically, the specification of the charging roller 2 is as follows:

a. core metal 2*a*: a stainless steel rod with a diameter of 6 mm;

b. undercoat layer 2*b*: formed of foamed ethylene-propylene-diene terpolymer (EPDM) in which carbon black has been dispersed; 0.5 g/cm$^3$ in specific gravity; $10^2$-$10^9$ ohm·cm in volume resistivity; and 3.0 mm in thickness;

c: intermediary layer 2*c*: formed of acrylonitrile-butadiene rubber (NBR) in which carbon black has been dispersed; $10^2$-$10^5$ ohm·cm in volume resistivity; and 700 μm in thickness; and d. surface layer 2*d*: formed of Toresin resin (a fluorinated compound), in which tin oxide and carbon black have been dispersed; $10^7$-$10^{10}$ ohm·cm in volume resistivity; 1.5 μm in surface roughness (10 point average surface roughness Ra in JIS); and 10 μm in thickness.

As shown in FIG. 2, a flexible film-like charging roller cleaning member for cleaning the surface of the fixation roller 2 is abutted against the surface of the charging roller 2. The charging roller cleaning member 2*f* is fixed, at one of its edges, to a supporting member 2*g* which is reciprocated by a predetermined distance in the direction also parallel to the longitudinal direction of the charging roller 2. Further, the charge roller cleaning member 2*f* is positioned so that its portion adjacent to its free edge forms a contact nip with the charging roller 2.

The supporting member 2*g* is driven by a driving apparatus (not shown) through a gear train so that it is reciprocated by the predetermined distance in its longitudinal direction. By the reciprocating motion of the supporting member 2*f*, the surface (layer 2*d*) of the charge roller 2 is rubbed by the charge roller cleaning member 2*f*, transfer residual toner deposited on the surface of the charge roller 1 as residual toner is supplied again with an appropriate amount of electric charge of normal polarity, so that it can be returned onto the photosensitive drum.

The exposure device 3 is a laser beam scanner employing a semiconductor laser. The exposure device 3 effects scanning exposure (imagewise exposure) of the uniformly charged peripheral surface of the photosensitive drum 1, at an exposure portion B, with a scanning laser beam L which is modulated in correspondence with image formation signals inputted into the image forming apparatus from an unshown host such as an image reading apparatus. A surface potential of the photosensitive drum 1 at a portion irradiated with the laser beam (exposure light) L is changed. In this embodiment, the surface potential at an image exposure portion of the photosensitive drum 1 is −150 V. As a result, on the surface of the photosensitive drum 1, an electrostatic latent image corresponding to image information subjected to scanning exposure with the laser beam L is successively formed.

The developing device 4 is a reversal developing device of two-component magnetic brush development type. The developing device 4 has a function of effecting reversal development of the electrostatic latent image to be visualized in a visible image by depositing toner on an exposure portion (light portion) at the surface of the photosensitive drum 1. The developing device 4 includes a developer container 4*a* and a nonmagnetic developing sleeve 4*b* which contains therein a fixed magnet roller 4*c* and is rotatably disposed at an opening of the developer container 4*a*. The developing device 4 further includes a regulation blade 4*d* for permitting coating developer (toner) 4*e* in the developer container 4*a* in a thin layer on the developing sleeve 4*b*. The developing sleeve 4*b* is rotated so that the developer (toner) 4*e* coated thereon is conveyed to a developing portion C at which the developing sleeve 4*b* and the photosensitive drum 1 are located opposite to each other. The developer 4*e* in the developer container 4*a* is a mixture of toner and a magnetic carrier. In the developing device 4, two developer stirring members 4*f* are rotated so that the developer 4*e* can be conveyed toward the developing sleeve 4*b* while uniformly stirring the developer 4*e*.

The magnetic carrier has a volume resistivity of about $10^{13}$ ohm·cm and a particle size of 40 μm. The toner is triboelectrically charged to a negative polarity by rubbing it and the magnetic carrier together. Further, a toner concentration of the toner in the developer container 4*a* is detected by an unshown concentration sensor. On the basis of detection information of the toner concentration, an appropriate amount of toner is supplied from a toner hopper 4*g* so as to keep the toner in the developer container 4*a* at a constant level.

The developing sleeve 4*b* is disposed close and opposite to the photosensitive drum 1 at the developing portion C with a closest distance therebetween of 300 μm. The developing sleeve 4*b* is supported by the developer container 4*a* so that it is rotationally driven in a direction (of an identical arrow R4) identical to the rotation direction (counterclockwise direction of the arrow R1) of the photosensitive drum 1. At the developing portion C, the photosensitive drum 1 and the developing sleeve 4*b* are rotated in opposite directions each other.

To the developing sleeve 4*b*, a predetermined bias (voltage) is applied from a power source S2. The developing bias voltage applied to the developing sleeve 4*b* is an oscillating voltage consisting of a DC voltage (Vdc) and an AC voltage (Vac) superposed with each other. More specifically, the DC voltage is −350 V and the AC voltage has a peak-to-peak voltage of 8 kV.

The transfer roller 5 as the transfer member is pressed against the photosensitive drum 1 at a predetermined pressing force to form a transfer portion D therebetween. The transfer roller 5 has a function of transferring a toner image formed on the surface of the photosensitive drum 1 onto a recording material P, as a transfer material such as sheet, at the transfer portion D by applying thereto a transfer bias (voltage) from a power source S3. The transfer bias is of a positive polarity opposite to the negative polarity as the normal charge polarity of the toner. More specifically, the transfer bias voltage is +500 V.

The fixing device 6 includes rotatable fixation roller 6*a* and pressure roller 6*b*. The fixing device fixes the toner image transferred onto the surface of the recording material P under application of heat and pressure while nipping and conveying the recording material P at a nip between the fixation roller 6*a* and the pressure roller 6*b*.

The auxiliary charging member 7 for erasing a history of an image on the image bearing member (photosensitive member) after the transfer and the transfer residual toner charging member 8 as the toner charging member for electrically charging the passing toner on the image bearing member by applying thereto a voltage of an identical polarity to the toner charge polarity are constituted by a combination of a brush-like member 7*a* and a supporting member 7*b* therefor and a combination of a brush-like member 8*a* and a supporting member 8*b* therefor, respectively. These members 7*a*, 7*b*, 8*a* and 8*b* have an appropriate electroconductivity. The brush-like members 7*a* and 8*a* are disposed at positions in contact with the surface of the photosensitive drum 1. More specifically, the auxiliary charging member 7 and the surface of the photosensitive drum 1 contact each other at a contact portion E. Further, the transfer residual toner charging member 8 and the surface of the photosensitive drum 1 contact each other at a contact portion F.

Next, an image forming operation of the printer will be described.

During image formation, the photosensitive drum 1 is rotated at a predetermined peripheral speed in the arrow R1 direction (counterclockwise direction) by the unshown drive apparatus. To the charge roller 2, the charge bias is applied. The charge roller 2 is rotated in the arrow R2 direction (clockwise direction) opposite to the rotation direction of the photosensitive drum 1 to electrically charge to the surface of the photosensitive drum 1 to −500 V.

The photosensitive drum 1 charged by the charge roller 2 is subjected to the scanning exposure with the laser light L by the exposure device 3 to form an electrostatic latent image corresponding to the inputted image information. The surface potential at the exposure portion is −150 V. The toner in the developing device 4 is electrically charged by the developing sleeve 4*b* to the same polarity as the charge polarity (negative polarity) of the photosensitive drum 1. The electrostatic latent image formed on the photosensitive drum 1 is developed into a toner image by depositing the negatively charged toner on the electrostatic latent image at the developing portion C.

The toner image on the photosensitive drum 1 reaches the transfer portion D between the photosensitive drum 1 and the transfer roller 5 by the rotation of the photosensitive drum 1 in the arrow R1 direction. The transfer roller 5 is rotated in the arrow R5 direction opposite to the rotation direction (arrow R1 direction) of the photosensitive drum 1. At the same timing as the time when the toner image reaches the transfer portion D, the recording material P is fed to the transfer portion D by unshown registration rollers.

Onto the recording material P fed to the transfer portion, the toner image on the photosensitive drum 1 is transferred by the transfer roller 5 to which the transfer bias of the polarity (positive polarity) opposite to the charge polarity of toner of the toner image. The recording material P onto which the toner image is transferred is conveyed into the fixing device 6 in which the toner image is fixed on the recording material P by heat and pressure at the fixing portion between the fixation roller 6*a* and the pressure roller 6*b*. Finally, the recording material P is discharged outside the portion. In the above described manner, a succession of image forming operation is completed. In the case where there is a subsequent recording material, a similar operation is repeated until the recording material is not fed.

Further, after the toner image is transferred onto the recording material P, the transfer residual toner remaining on the surface of the photosensitive drum 1 reaches the developing portion C via the charging portion A and the exposure portion B by the rotation of the photosensitive drum 1. The transfer residual toner which has reached the developing portion C is recovered by a fog-preventing bias (voltage) during development by the developing sleeve 4*b* of the developing device 4 is a subsequent step or later (the simultaneous developing and cleaning). The fog-preventing bias is a difference in electric potential (Vback) between a DC voltage applied to the developing sleeve 4*b* and a surface potential of the photosensitive drum 1. The recovered transfer residual toner (residual developer) is used in a subsequent step or later.

The developing sleeve 4*b* of the developing device 4 is rotated, at the developing portion C, in the direction of the arrow R4 opposite to the moving direction of the surface of the photosensitive drum 1, as described above. Rotating the developing sleeve 4*b* in this manner is advantageous for the recovery of the residual toner on the photosensitive drum 1.

When the transfer residual toner on the surface of the photosensitive drum 1 goes through the exposure portion B, a subsequent exposure step is effected on the surface of the transfer residual toner. However, the amount of the residual toner is small, and therefore, the presence of the residual toner does not adversely affect a subsequent toner image formation.

Incidentally, in terms of polarity, the transfer residual toner is the mixture of the normally charged toner, reversely charged toner (polarity-reversed toner), and the charged toner having an insufficient amount of electrical charge. Of these, when the polarity-reversed toner or the insufficiently charged toner passes through the charging portion A, it can be deposited on the charging roller 2, thus contaminating the charging roller 2 beyond the tolerable range to cause charging failure.

Further, in order to effectively perform the above-described simultaneous developing and cleaning, it is necessary that the transfer residual toner on the photosensitive drum 1, which is being conveyed to the developing portion C, is normal in charge polarity, i.e., the negative polarity.

Further, with user needs variations in recent years, when an image having a high image ratio such as a photographic image is continuously formed on the recording material, a large amount of transfer residual toner can be caused to occur at a time. Also in such a case, the transfer residual toner may not be removed and recovered from the photosensitive drum 1 at one time.

In the printer 20 of this embodiment, between the transfer portion D and the charging portion A, the auxiliary charging member 7 and the transfer residual toner charging member 8 are disposed.

To the auxiliary charging member 7, a positive-polarity voltage (+300 V) is applied from a voltage application power source S4. Further, to the transfer residual toner charging member 8, from a voltage application power source S5, a negative-polarity voltage (−800 V) is applied.

After the toner image is transferred onto the recording material P at the transfer portion D, the transfer residual toner remaining on the photosensitive drum 1 reaches the contact portion E between the auxiliary charging member 7 and the photosensitive drum 1 by the rotation of the photosensitive drum 1 in the arrow R1 direction. At the contact portion E, the transfer residual toner is one uniformly charged to a positive portion.

Further, the auxiliary charging member 7 changes the surface potential of the photosensitive drum 1 to approximately 0 V in order to permit discharge with reliability by the transfer residual toner charging member 8 disposed downward therefrom.

Then, the transfer residual toner uniformly charged to the positive polarity by the auxiliary charging member 7 reaches the contact portion F between the transfer residual toner charging member 8 and the photosensitive drum 1 by the rotation of the photosensitive drum 1 in the arrow R1 direction. At the contact portion F, when the transfer residual toner passes through the transfer residual toner charging member 8, the charge polarity thereof is uniformly changed to the normal charge polarity, i.e., negative polarity. The transfer residual toner after passing through the transfer residual toner charging member 8 has an amount of electric charge of −70 μC/g.

Next, the recovery of the transfer residual toner in the developing step will be described.

The developing device 4 in this embodiment cleans the photosensitive drum surface and recovers the transfer residual toner at the same time with the development (cleanerless method). The toner subjected to development on the photosensitive drum 1 has a charge amount of −25 μC/g.

In order to recover the transfer residual toner on the photosensitive drum 1 into the developing device 4, the charge amount of the transfer residual toner is generally required to be 0.5-1.8 times that during the development (−25 μC/g). However, in order to prevent the toner deposition on the charging roller 2, the charge amount of the transfer residual toner is largely changed to a negative value of −70 μC/g by the transfer residual toner charging member 8. For this reason, it is necessary to effect charge removal in order to recover the transfer residual toner in the developing device 4.

To the charging roller 2, an AC voltage Vac (frequency: 2 kHz, peak-to-peak voltage Vpp: 1400 V) is applied in order to effect charge-processing the photosensitive drum 1 surface, so that the transfer residual toner on the photosensitive drum 1 is charge-removed by the AC voltage Vac. Accordingly, the charge amount of the transfer residual toner after passing through the charging portion A is −30 μC/g. For these reasons, the transfer residual toner deposited on a portion on which the toner remaining on the photosensitive drum 1 should not be deposited, is recovered into the developing apparatus 4.

As described above, the printer 20 effects charge-processing so that the charge amount of the transfer residual toner on the photosensitive drum 1 carried from the transfer portion D to the charging portion A is uniformized to the normal polarity, i.e., negative polarity by the auxiliary charging member 7 and the transfer residual toner charging member 8. Further, by applying the negative bias to the charge roller 2, it is possible to prevent the transfer residual toner from being deposited on the charge roller 2.

The portion 20 can also change the charge amount of the transfer residual toner charge-processed to have the negative polarity by the transfer residual toner charging member 8 to an appropriate charge amount capable of developing the electrostatic latent image while electrically charging the photosensitive drum 1 to a predetermined potential by the charge roller 2. As a result, the printer 20 is capable of efficiently perform the recovery of the transfer residual toner by the developing device 4.

Figure 3:
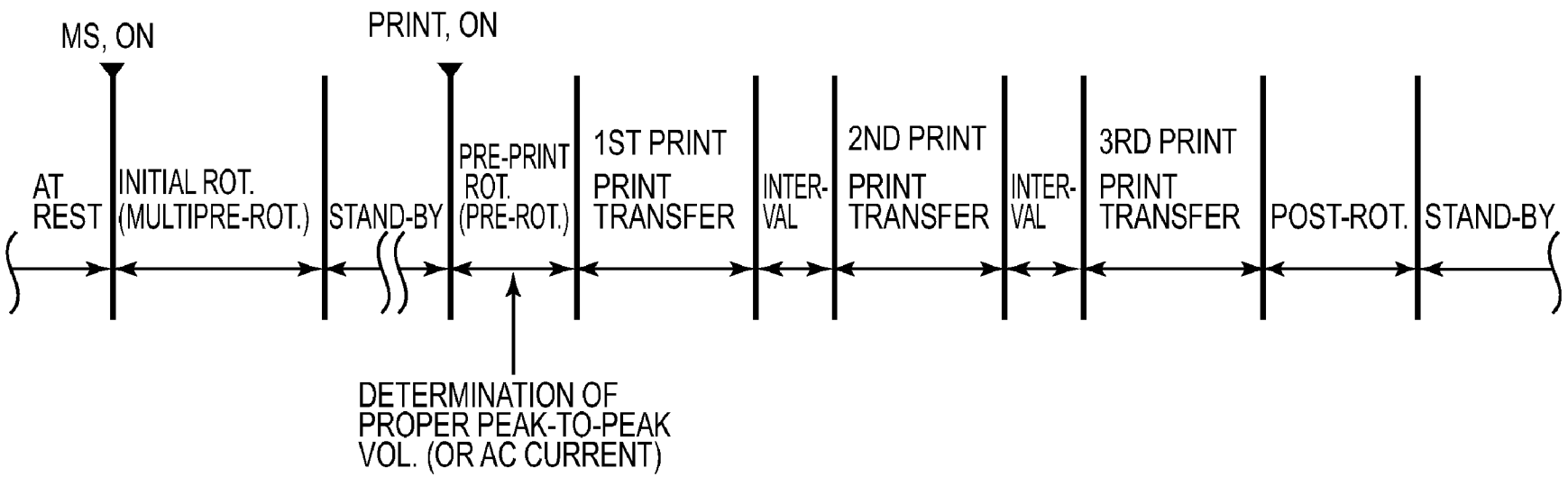
FIG. 3 is an operation sequence common to the image forming apparatuses of respective embodiments of the present invention.

Next, based on an operation sequence diagram shown in FIG. 3, an entire operation of the printer will be described.

(a) Initial Rotation Operation (Multiple Pre-Rotation Step)

An initial rotation operation is an operation in an actuating operation period (startup operation period or warm-up period) during startup of the printer. By turn-on of a power switch, the photosensitive drum is rotated. Further, the fixing device 6 rises in temperature up to a predetermined temperature.

(b) Pre-Print Rotation Operation (Pre-Rotation Step)

A pre-print rotation operation is a pre-rotation operation of the photosensitive drum before image formation in a period from an ON-state of print signal to start of an actual image forming (printing) step operation. In this period, when the print signal is inputted, the photosensitive drum effects the pre-rotation operation in succession to the initial rotation operation. When the print signal is not inputted, drive of a main motor is once stopped after completion of the initial rotation operation, so that the photosensitive drum stops its rotation. The printer 20 is kept in stand-by state until the print signal is inputted. When the print signal is inputted, the photosensitive drum effects the pre-print rotation operation.

In this embodiment, in this pre-print rotation operation period, operation/determination program for an appropriate peak-to-peak voltage value (or an AC current value) of an applied AC voltage in a charging step of a printing step is executed. This will be described more specifically later.

(c) Printing Step (Image Forming Step)

When the predetermined pre-print rotation operation is completed, an image forming process is performed with respect to the photosensitive drum. The toner image formed on the photosensitive drum surface is transferred onto the recording material, and is fixed on the recording material by the fixing device. The recording material is then printed out. In the case of a continuous print mode, this printing step is repetitively performed for a predetermined number n of set print sheets . . .

(d) Interval step

An interval step is performed in a period, of non-sheet-passing state of the recording material at the transfer portion D, from passing of a trailing edge of one sheet of recording material at the transfer portion D to reaching of a leading edge of a subsequent sheet of recording material.

(e) Post-Rotation Operation

After the printing step of the recording material is completed, the main motor is rotated for a predetermined time. As a result, the photosensitive drum continues its rotation for the predetermined time. The post-rotation operation is performed for the predetermined time (period).

(f) Standby

When the predetermined post-rotation operation is completed, the main motor is stopped and the rotation of the photosensitive drum is also stopped. The printer is kept a standby state until a subsequent print start signal is inputted. In the case of printing only one sheet of recording material, the printer is placed in the standby state though the post-rotation operation after the printing. When the print start signal is inputted in the standby state of the printer, the operation goes to the above-described pre-rotation step.

The printing step of (c) is performed during image formation. Further, the initial rotation operation of (a), the pre-rotation operation (b), the interval step (d), and the post-rotation step (e) are performed during non-image formation.

Figure 4:
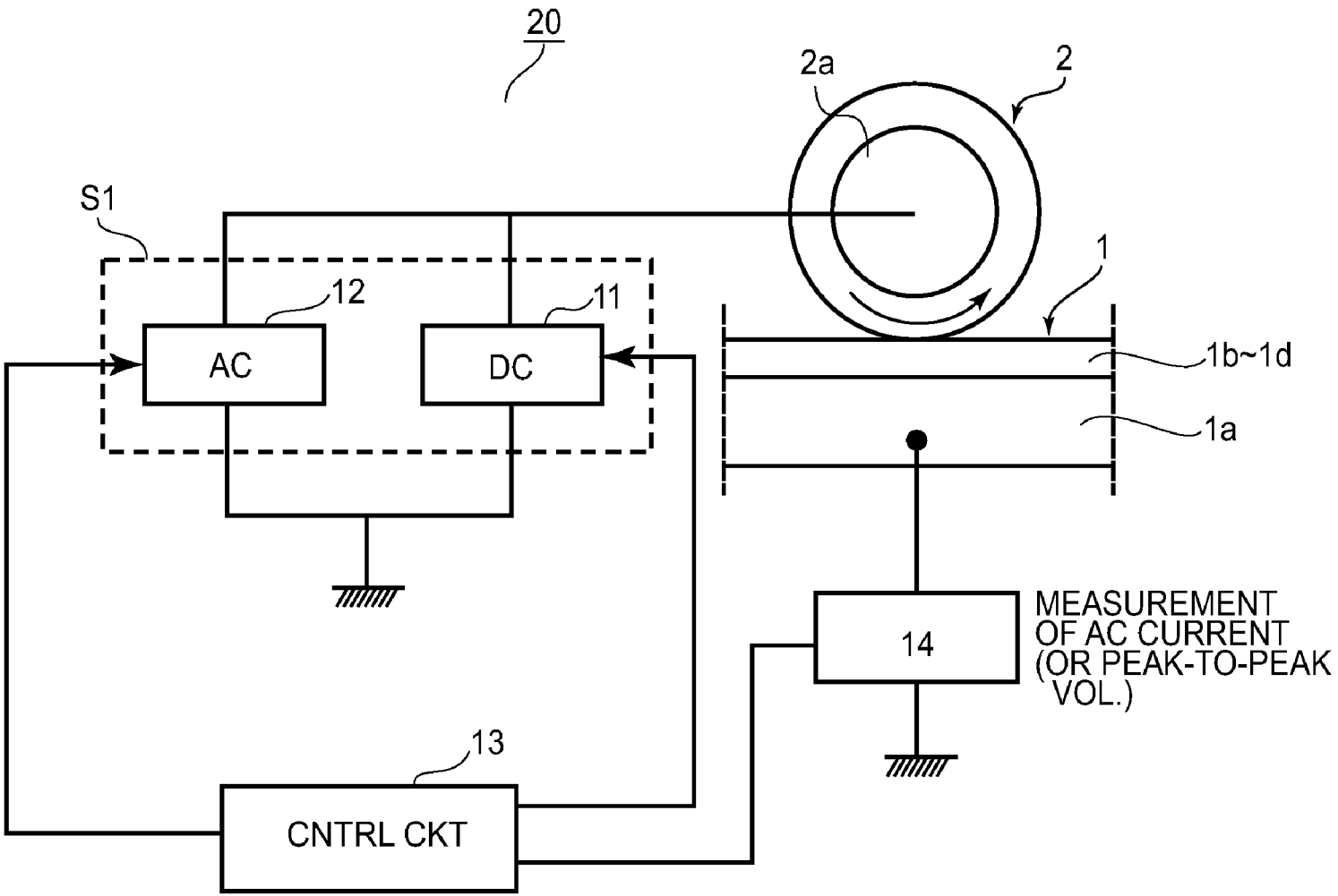
FIG. 4 is a block circuit diagram showing a charge bias application system of the image forming apparatus according to a First Embodiment of the present invention.

FIG. 4 is a block circuit diagram of a charging bias application system with respect to the charge roller 2.

The peripheral surface of the rotation photosensitive drum 1 is charge-processed to a predetermined potential by applying a predetermined oscillating voltage, consisting of a DC voltage superposed with an AC voltage having a frequency f (bias voltage Vdc+Vac), from the power source S1 to the charge roller 2 via the core metal 2*a*. The power source S1 for the charge roller 2 includes a DC power source 11 and an AC power source 12.

A control circuit (CPU) 13 as control means has a function of controlling the power source S1 so that either one or both (the separation voltage of the DC voltage and the AC voltage and applied to the charge roller 2 by turning the DC power source 11 or/and the AC power source 12 of the power source S1 on or off. The control circuit 13 also has a function of effecting the processing/determination program for the DC voltage value applied from the DC power source 11 to the charge roller 2 and the peak-to-peak voltage value of the AC voltage applied from the AC power source 12 to the charge roller 2. An AC current value measurement circuit 14 is a circuit for measuring a value of AC current passing through the charge roller 2 via the photosensitive drum 1. The measured value by the AC current value measurement circuit 14 is inputted into the control circuit 13 as AC current value information.

Next, a control method of the peak-to-peak voltage of the AC voltage applied to the charge roller 2 during the printing will be described.

An embodiment of discharge current converted into numerical value according to a definition described below (formula 1) is used as a substitution for an actual amount of AC discharge and correlated with abrasion of the photosensitive drum, image flow, and charge uniformity.

Figure 5:
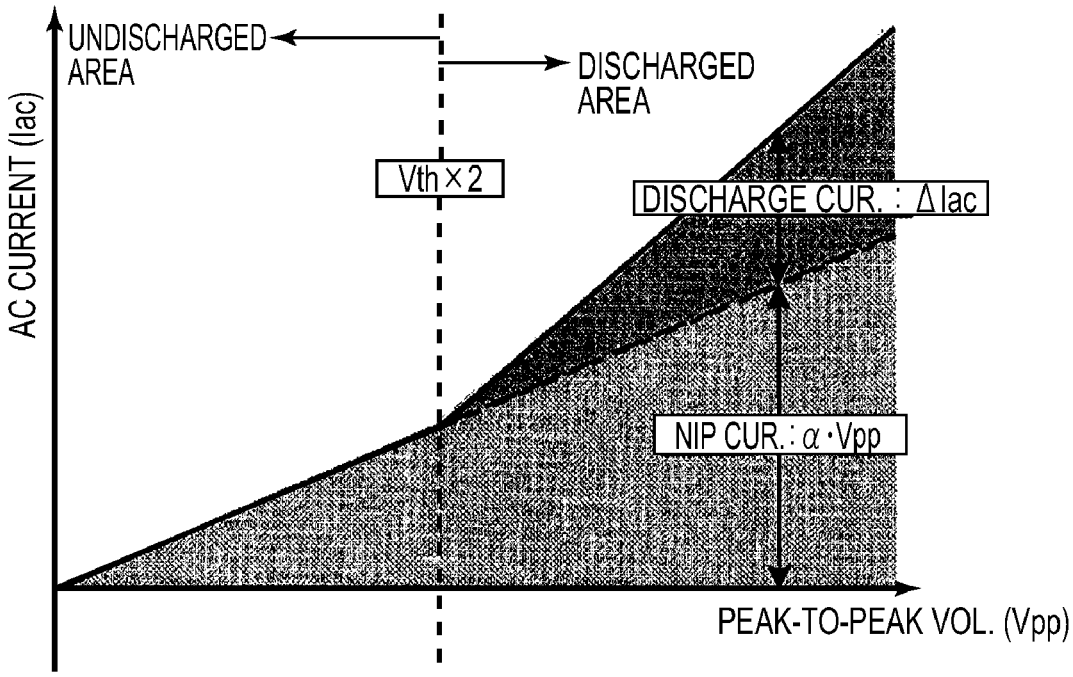
FIG. 5 is a schematic diagram for illustrating common measurement of an amount of discharge current employed in the image forming apparatuses of respective embodiments of the present invention.

More specifically, as shown in FIG. 5, an AC current Iac has a linear relation to a peak-to-peak voltage Vpp in an area less than a value of (discharge start voltage Vth)×2 (V) (undischarged area) and is then linearly increased gradually in a discharged area with an increasing peak-to-peak voltage value. In a similar experiment in a vacuum, the linearity of Iac is kept also in the discharged area, so that the resultant increment of Iac represents a discharge current ΔIac.

When a ratio of the AC current Iac to the peak-to-peak voltage Vpp in the undischarged area less than the value of (discharge start voltage Vth)×2 (V) is taken as α, an AC current, other than the current due to discharge, such as a current flowing through the charging portion A (hereinafter referred to a "nip current") is represented by α.Vpp. A difference between the current value Iac measured during the application of a voltage equal to or more than the value of (discharge start voltage Vth)×2 (V) and the value α.Vpp is represented by the following formula 1:

$$\Delta Iac = Iac - \alpha . Vpp \qquad \text{(formula 1)}$$

The value ΔIac is defined as discharge current amount as a substitution for a discharge amount.

The discharge current amount is changed depending on changes in environmental condition and continuous image formation state in the case where the photosensitive drum 1 is electrically charged under control at a constant voltage or a constant current. This is because a relationship between the peak-to-peak voltage and the discharge current amount and a relationship between the AC current value and the discharge current amount are changed.

In an AC constant current control method, the charging of the photosensitive drum 1 is controlled by a total amount of current flowing from the charge roller 2 to the photosensitive drum 1. The total current amount is a sum of the nip current α.Vpp and the discharge current amount ΔIac which is carried by the discharge at the non-contact portion. In the constant current control method, the charge control is effected by current including not only the discharge current which is current necessary to actually charge electrically the photosensitive drum 1 but also the nip current.

For this reason, the discharge current amount ΔIac cannot be actually controlled. In the constant current control method, even in the case of effecting control at the same current value, depending on an environmental change of a material for the charge roller 2, the discharge current amount is decreased when the nip current is increased and is increased when the nip current is decreased. For this reason, it is difficult to completely suppress a change (increase/decrease) in discharge current amount even by the AC constant current control method. When the life of the printer is intended to be prolonged, it is difficult to compatibly realize abrasion resistance of the photosensitive drum and charge uniformity.

In the present invention, in order to always obtain a desired discharge current amount, the control is effected in the following manner.

When the desired discharge current amount is taken as D, a method of determining a peak-to-peak voltage providing the discharge current amount D will be described.

In this embodiment, during the pre-print rotation operation, the operation/determination program for the appropriate peak-to-peak voltage value of the AC voltage applied to the charge roller 2 in the charging step during the printing step in the control circuit 13 is executed.

This will be described more specifically with reference to the Vpp-Iac graph of FIG. 6 and a control flow chart of FIG. 7.

The control circuit 13 (FIG. 4) controls the AC power source 12 so that peak-to-peak voltages (Vpp) of three values in the discharged area and those of three values in the undischarged area are successively applied to the charge roller 2. The resultant AC current values flowing into the charge roller 2 via the photosensitive drum 1 during the application of these peak-to-peak voltages are measured by the AC current value measurement circuit 14 and inputted into the control circuit 13.

Next, the control circuit 13 performs collinear approximation of a relationship between the peak-to-peak voltage and the AC current in the discharged area and the undischarged area, respectively, on the basis of associated three measured values by using least square method to obtain the following formulas 2 and 3.

(Collinear Approximation in Discharged Area)

$$Y_\alpha=\alpha X_\alpha+A \quad \text{(formula 2)}$$

(Collinear Approximation in Undischarged Area)

$$Y_\beta=\beta X_\beta+B \quad \text{(formula 3)}$$

Thereafter, a peak-to-peak voltage Vpp corresponding to the discharge current amount D is determined as a difference between the collinear approximation in the discharged area (formula 2) and that in the undischarged area (formula 3). As a result, the following formula 4 is obtained.

$$Vpp=(D-A+B)/(\alpha-\beta) \quad \text{(formula 4)}$$

Figure 6:
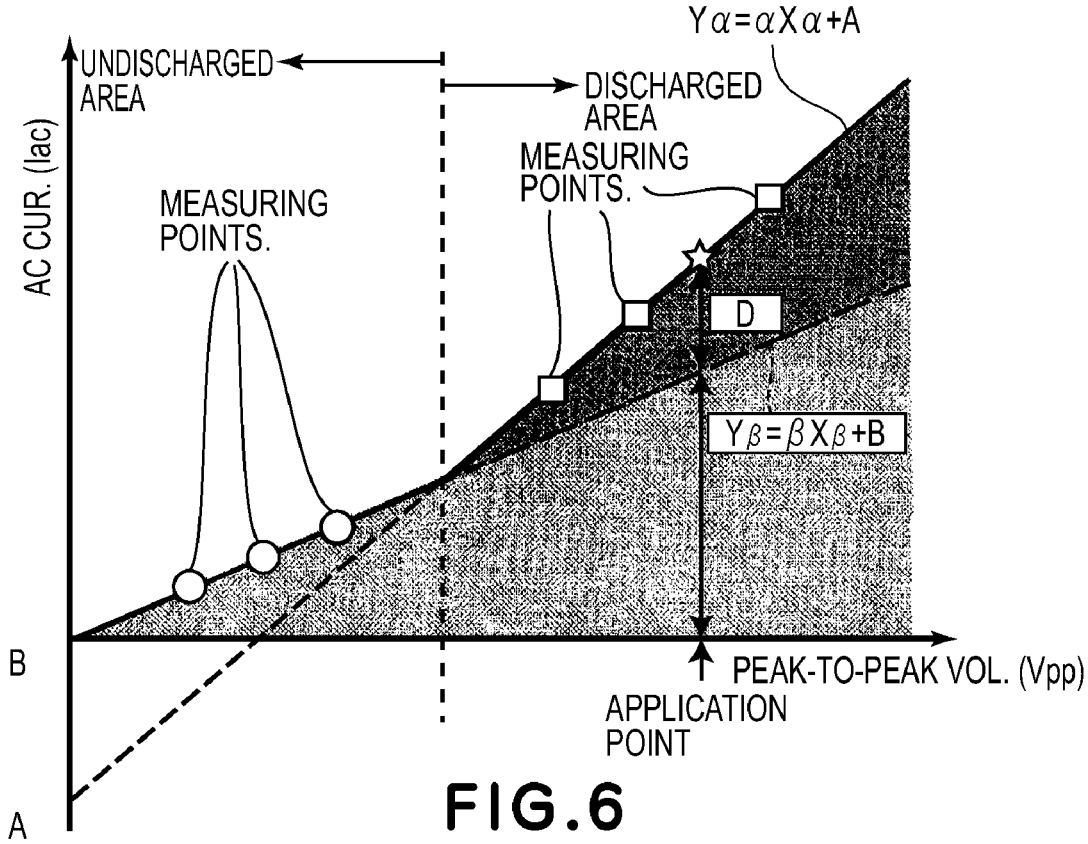
FIG. 6 is a graph showing a common relationship between a peak-to-peak voltage and an amount of AC current measured during pre-print rotation in the image forming apparatuses of respective embodiments of the present invention.
Figure 7:
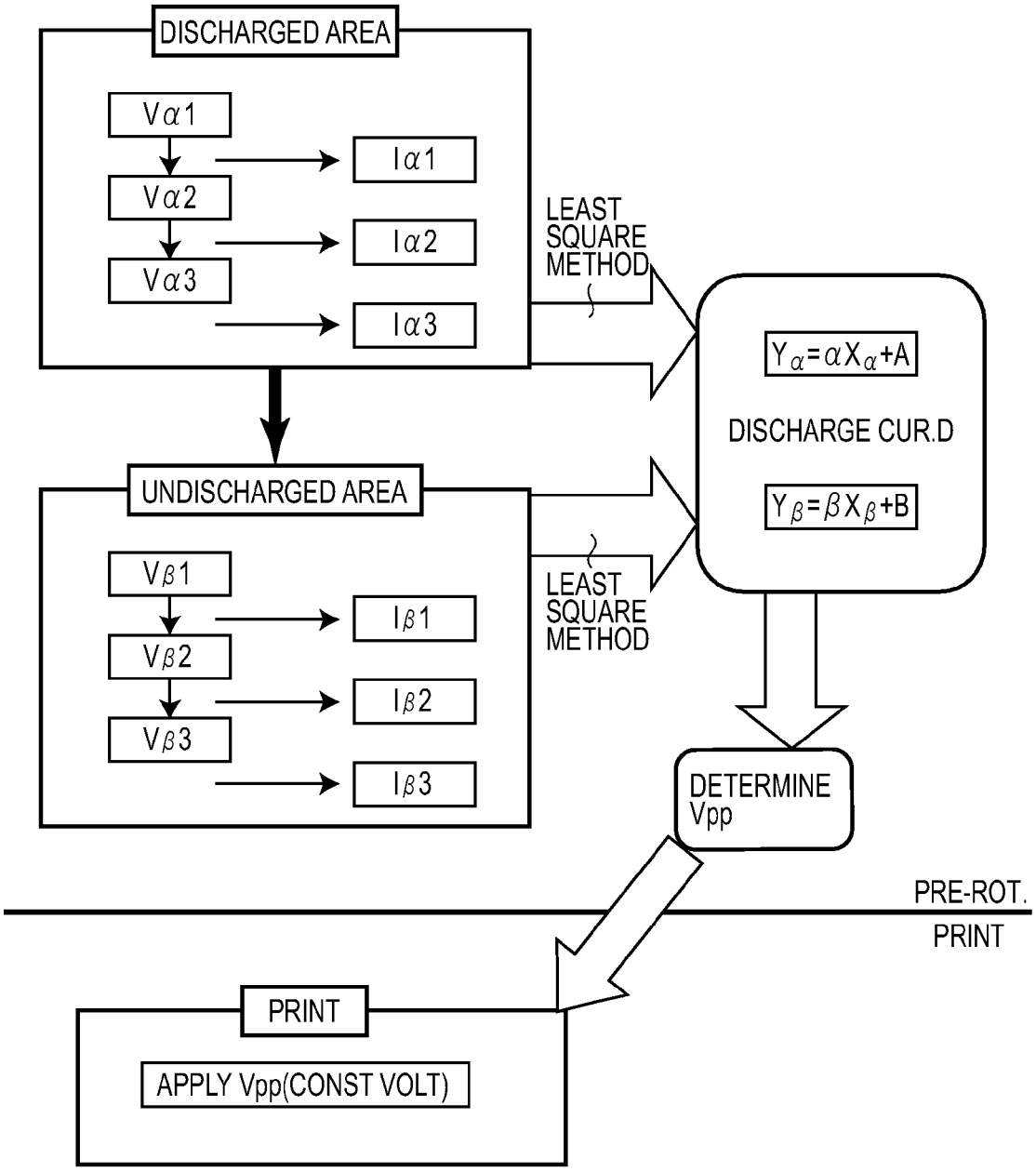
FIG. 7 is a common charge control flowchart in the image forming apparatuses of respective embodiments of the present invention.

Here, a function fI1 (Vpp) of peak-to-peak voltage (Vpp) and AC current (Iac) in the undischarged area in FIG. 5 and a function fI2 (Vpp) of peak-to-peak voltage (Vpp) and AC current (Iac) in the discharged area in FIG. 5 correspond to $Y_\beta=\beta X_\beta+B$ (formula 3) and $X_\alpha=\alpha X_\alpha+A$ (formula 2) in FIG. 6, respectively.

Accordingly, the discharge current amount D is represented by the formula below.

$$fI2(Vpp)-fI1(Vpp)=D$$

In other words, the discharge current amount D is represented by the formula below.

$$Y_\alpha Y_\beta=(\alpha X_\alpha+A)-(\beta X_\beta+B)=D$$

Further, the formula 4, i.e., Vpp=(D−A+B)/(α−β) can be deviated from the formula for D, i.e., fI2(Vpp)−fI1(Vpp)=D in the following manner.

The discharge current amount D is represented by the following formulas.

$$fI2(Vpp)-fI1(Vpp)=Y\alpha-Y\beta=D$$

$$(\alpha X_\alpha+A)-(\beta X_\beta+B)=D$$

Now, assuming that a value of X providing D is sought and a resultant point is Vpp, the discharge current amount D is represented by the following formula.

$$(\alpha Vpp+A)-(\beta Vpp+B)=D$$

Accordingly, the peak-to-peak voltage Vpp is represented by the following formula.

$$Vpp=(D-A+B)/(\alpha-\beta)$$

Then, the peak to peak voltage applied to the charge roller 2 is switched to Vpp obtained according to the formula 4 described above, and the operation goes to the above-described printing step while effecting the constant voltage control.

As described above, the printer calculates a peak-to-peak voltage, required for obtaining a predetermined discharge current amount during the printing, every during the preprint rotation. As a result, the printer is capable of applying the calculated peak-to-peak voltage during the printing by the constant voltage control. As a result, the printer is capable of accommodating deviations or irregularities in production of the charge roller 2, electric resistance due to environmental change in material, and high voltage applied from a main assembly of the printer, thus providing a desired discharge current amount with reliability. During the control for determining the discharge current amount, the AC current is detected, so that an OFF-state of the application of DC voltage presents no problem.

As described above, the printer always causes a constant amount of discharge without causing excessive discharge by the discharge current control permitting a constant discharge current amount, so that it is possible to effect uniform charge without causing an occurrence of toner melt sticking on the image bearing member which is a problem of the cleaner-less system In such a image forming apparatus using the cleaner-less system, by the rotation of the image bearing member also in a period other than those of image formation in which the pre-rotation or the post-rotation is effected, a slight amount of toner is discharged from the auxiliary charging member or the transfer residual toner charging member. In view of this problem, in the cleaner-less method employed in this embodiment, also during the periods for the pre-rotation and the post-rotation, the bias voltage is applied to the auxiliary charging member 7 and the transfer residual toner charging member 8 to effect such an operation that the discharged toner is recovered into the developing device 4.

For that purpose, it is necessary to apply the bias voltage to the auxiliary charging member 7 and the transfer residual toner charging member 8. In this case, however, the surface potential of the photosensitive drum 1 is increased. For this reason, there is a possibility that minute toner particles on the photosensitive drum 1 are deposited on the surface of the charge roller 2 due to the potential difference between the charge roller surface and the photosensitive drum surface immediately before the charge roller 2 (between the portions A and F shown in FIGS. 1 and 2) when the supply of the DC voltage to the charge roller is stopped.

During ordinary pre-rotation and post-rotation, the toner described on the charge roller surface at the above described timing is rubbed with the charge roller cleaning member 2*f* shown in FIG. 2, so that, that is eventually changed into the toner having the normal charge polarity and returned onto the photosensitive drum 1.

However, when the toner is deposited instantaneously on the charge roller 2 during the discharge current control, the deposited toner results in an uneven contamination in the circumferential direction of the charge roller. As a result, in the circumferential direction of the charge roller, an irregularity in electric resistance at the surface of the charge roller is caused to occur. In such a state, when the above described discharge current control is performed, an error is caused also in the AC current value I measured during the discharge current control, so that it is impossible to apply the discharge current in an appropriate amount.

Figure 8:
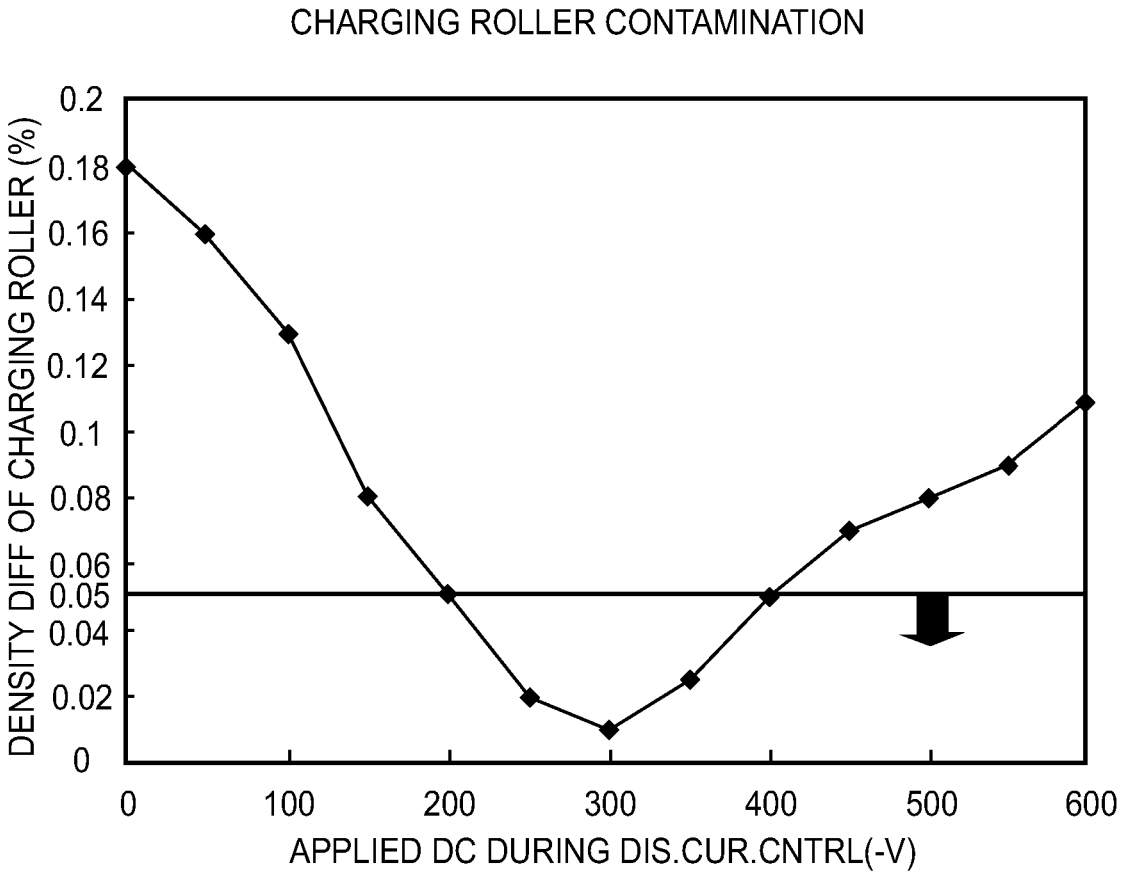
FIG. 8 is a graph showing a relationship between a contamination density difference of a charge roller in its circumferential direction and a DC voltage applied to the charge roller during discharge current control when a surface potential of a photosensitive drum immediately before the charge roller is −300 (V) in the image forming apparatus according to the First Embodiment of the present invention.

FIG. 8 is a graph showing a relationship between a contamination density difference of the charge roller 2 in its circumferential direction during the discharge current control and a DC voltage applied during the discharge current control when the surface potential of the photosensitive drum immediately before the charge roller.

The charge roller contamination is determined in the following manner.

A contamination of the charge roller is collected by transparent tape and taped onto white paper. By using a densitometer ("TC-DS", mfd. by TOKYO DENSHOKU Co., Ltd.), reflection densities of (contamination+tape+white paper) and (tape+white paper) are measured. The contamination of the charge roller 2 is evaluated as a contamination density (%) obtained according the following formula 5:

Contamination density (%)=(reflection density of contamination+reflection density of tape)−(reflection density of tape) (formula 5)

The contamination density difference of the charge roller 2 in its circumferential direction means a difference between a maximum and a minimum of the contamination density.

It has been found as a result of study that an error in AC current value I measured during the discharge current control is very small in the case where the contamination density difference in the charge roller circumferential direction is 0.05% to permit calculation of an appropriate discharge current value.

From the results of FIG. 8, it is possible to suppress the contamination density difference in the charge roller circumferential direction so as to be 0.05 % or below when the difference between the surface potential of the photosensitive drum immediately before the charge roller 2 and the value of DC voltage applied to the charge roller during the discharge current control is ±100 V, more preferably ±50 V.

In the present invention, the printer (image forming apparatus) according to the present invention includes DC voltage control means for applying to the image bearing member charging member a DC voltage, which is substantially identical to a potential on the image bearing member before reaching the image bearing member charging member, during an operation for measuring a value of AC current passing through the image bearing member charging member, in order to set a condition of voltage to be applied to the image bearing member charging member during image formation, by applying an AC voltage to the image bearing member charging member in a state in which the voltage of the identical polarity to the charge polarity of the toner is applied to the toner charging member. In this embodiment, the control circuit 13 (CPU) effects control of a voltage applied to the DC power source 11 during the measurement of current. The printer of this embodiment is capable of preventing contamination of the charge roller with toner and unevenness in contamination during the discharge current control by setting the value of DC voltage applied during the discharge current control to be approximately the surface potential of the photosensitive drum immediately before the charge roller 2, specifically ±100 V, more preferably ±50 V, of the photosensitive drum surface potential. It is also possible to considerably extend the life of the charge roller 2. Further, stable discharge current control can be effected. Accordingly, the printer causes no excessive discharge, so that a constant amount of disharge is always caused. As a result, it is possible to stably maintain a high-quality image for a long period of time without causing melt-sticking of toner on the photosensitive drum. Further, the transfer residual toner is recovered into the photosensitive drum to be used again for developing the electrostatic latent image in a subsequent step or later, so that it is possible to prevent waste toner. Further, the discharge is capable of requiring less maintenance and can be reduced in size since it employs the cleanerless system.

The surface potential of the photosensitive drum immediately before the charge roller 2 is an estimate potential. For this reason, a change in surface potential of the photosensitive drum 1 in a period in which the photosensitive drum 1 is electrically charged by the charge roller 2 and then moved to a position immediately before the charge roller 2 will be described.

During the image formation, a DC potential of the charge roller 2 is −500 Vdc. A surface potential of the photosensitive drum 1 electrically charged by the charge roller 2 is −500 V. The surface potential of the photosensitive drum 1 after the toner image is transferred onto the recording material is −200 V. To the auxiliary charging member 7, a positive-polarity voltage (of +300 V) is applied from the voltage application power supply S4. To the transfer residual toner charging member 8, a negative-polarity voltage (of −800 V) is applied from the voltage application power source S5. The surface potential of the photosensitive drum 1 after it passes through the transfer residual toner charging member 8 is −300 V.

During the discharge current control, the surface potential of the photosensitive drum 1 after it passes through the auxiliary charging member 7 is approximately 0 V, so that the surface potential of the photosensitive drum 1 immediately before the charge roller 2 is determined by the voltage applied to the transfer residual toner charging member 8. Accordingly, in order that the photosensitive drum surface potential (−300 V) at a position immediately before the charge roller 2 is substantially equal to the DC potential of the charge roller 2, the DC potential of the charge roller 2 is changed from −500 Vdc to −300 Vdc by the control circuit 13. As a result, the transfer residual toner deposited on the photosensitive drum 1 cannot be deposited on the charge roller 2.

However, when the photosensitive drum 1 is rotated to reach the developing device 4 while keeping the surface potential at −300 V, the applied voltage to the developing sleeve 4*b* of the developing device 4 is −350 Vdc. For this reason, the transfer residual toner on the photosensitive drum 1 cannot be recovered by the developing device 4. In view of this phenomenon, the applied voltage (potential) to the developing device 4 is changed to −150 Vdc. As a result, the transfer residual toner jumps from the photosensitive drum 1 to the developing sleeve 4*b* and is recovered into the developing device 4. Then, the voltage applied to the developing device 4 after recovering the transfer residual toner is returned to the original voltage of −350 V. Incidentally, the voltage applied to the developing device 4 may also be originally −150 Vdc.

By satisfying the above-described potential relationships, it is possible to prevent the contamination of the charge roller 2 with toner and unevenness in contamination during the discharge current control.

Incidentally, the reason why the surface potential (−300 V) of the photosensitive drum 1 immediately before the charge roller 2 is made substantially equal to the DC potential of the charge roller 2 is as follows. The transfer residual toner is constituted by a mixture of normal-polarity toner electrically charged to a normal polarity, a slight amount of opposite-polarity toner electrically charged to an opposite polarity, and a slight amount of insufficiently charged toner having an improper amount of electric charge. For this reason, when the DC potential of the charge roller 2 and the photosensitive drum surface potential causes a difference therebetween, one of the normal-polarity toner and the opposite-polarity toner is deposited on the charge roller 2. As a result, the charge roller 2 is contaminated with the transfer residual toner.

In the present invention, as described above, it is possible to reduce an amount of the toner on the photosensitive member, electrically charged to the normal polarity, deposited on the image bearing member charging member.

(Printer of Second Embodiment)

The surface potential of the photosensitive drum 1 immediately before the charge roller 2 is changed under the influence of humidity in the printer. On the other hand, as described above, the surface potential of the photosensitive drum 1 immediately before the charge roller 2 is the estimate potential. For this reason, the surface potential of the photosensitive drum 1 immediately before the charge roller 2 may preferably estimated in view of humidity in the printer.

The printer of this embodiment is configured to estimate the surface potential of the photosensitive drum 1 immediately before the charge roller 2 in view of the humidity in the printer to adjust the voltage applied to the charge roller 2.

Figure 10:
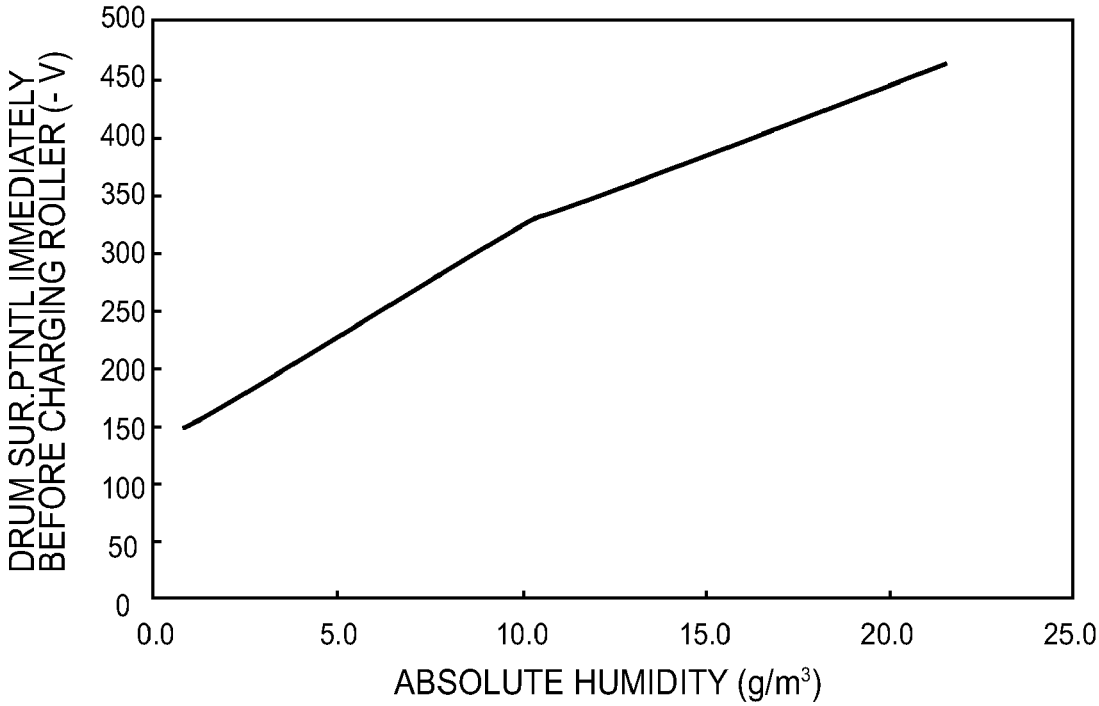
FIG. 10 is a graph showing a relationship between an ambient absolute humidity and a surface potential of the photosensitive drum immediately before the charge roller in the image forming apparatus according to the Second Embodiment of the present invention.

For this purpose, as shown in FIG. 10, the printer of this embodiment further includes an ambience sensor (thennometer and hygrometer) 15 as humidity (moisture content) detection means in addition to the circuit view of the printer shown in FIG. 4 in the First Embodiment. Other members or portions are the same as those in the First Embodiment, thus being omitted from illustration and explanation.

Detection information of the ambience sensor 15 is inputted into the control circuit 13 as environmental information. Further, the control circuit 13 has a function of executing the operation/determination program of an appropriate peak-to-peak voltage value of AC voltage applied to the charge roller 2 in a charging step of a printing step on the basis of AC current value information inputted from the AC current value measurement circuit 14 and the environmental information inputted from the environmental sensor 15.

FIG. 10 is a graph showing a relationship between the surface potential of the photosensitive drum immediately before the charge roller and ambient absolute humidity in the printer (image forming apparatus) when a voltage of +300 V is applied to the auxiliary charging member 7 and a voltage of −800 V is applied to the transfer residual toner charging member 8.

Figure 9:
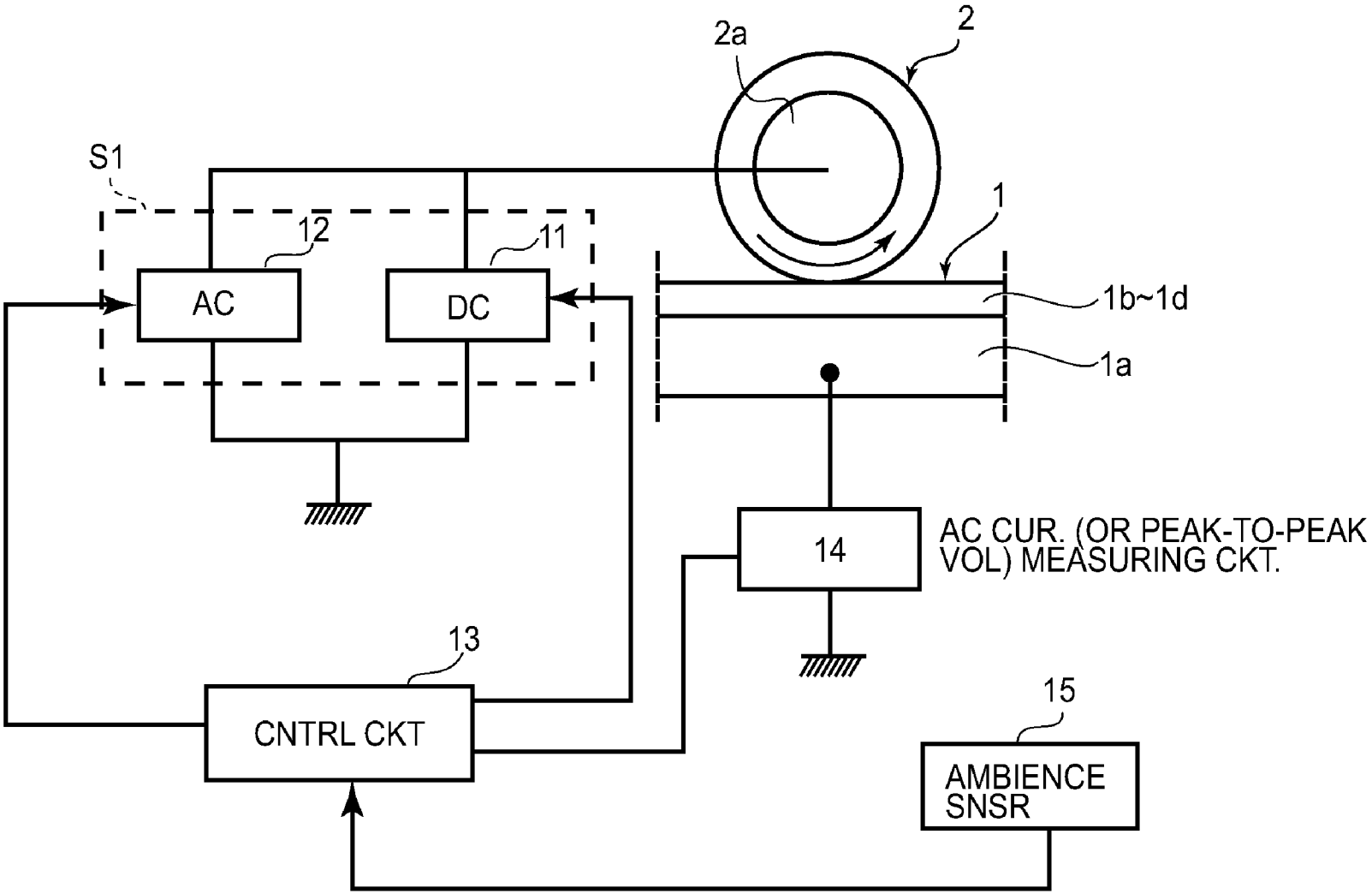
FIG. 9 is a block circuit diagram showing a charge bias application system of the image forming apparatus according to a Second Embodiment of the present invention.

The surface potential of the photosensitive drum 1 immediately before the charge roller 2 is changed successively depending on an amount of absolute humidity measured by the ambience sensor 15 shown in FIG. 9. In an environment of a large amount of absolute humidity, electric resistances of the auxiliary charging member 7 and the transfer residual toner charging member 8 are lowered, so that chargeability to the photosensitive drum 1 is increased at the same applied bias. As a result, the surface potential of the photosensitive drum 1 after passing through the auxiliary charging member 7 is closer to zero. Further, at the transfer residual toner charging member 8, an amount of flowing current of negative polarity is further increases, so that the surface potential of the photosensitive drum 1 immediately before the charge roller 2 is increased.

Further, in an environment of a small amount of absolute humidity, electric resistances of the auxiliary charging member 7 and the transfer residual toner charging member 8 are increased, so that chargeability to the photosensitive drum 1 is lowered at the same applied bias. As a result, the surface potential of the photosensitive drum 1 after passing through the auxiliary charging member 7 is not close to zero. For example, when the absolute humidity is 2 g/m$^3$, the surface potential of the photosensitive drum 1 after passing through the auxiliary charging member 7 is −200 V. Further, after passing through the transfer residual toner charging member 8, the surface potential of the photosensitive drum 1 after passing through the auxiliary charging member 7 and the bias applied to the transfer residual toner charging member 8 cause a small potential difference, so that an amount of negative flowing current is decreased. As a result, the surface potential of the photosensitive drum 1 immediately before the charge roller 2 is lowered.

Figure 11:
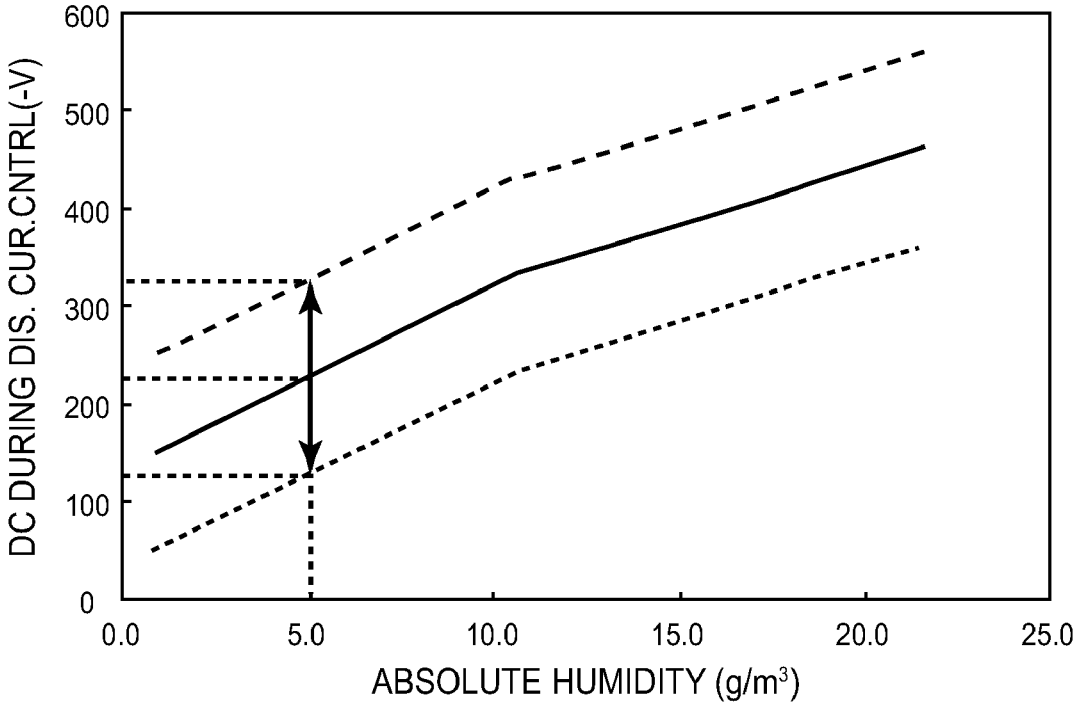
FIG. 11 is a graph showing a relationship between an ambient absolute humidity and an applied DC voltage during discharge current control in the image forming apparatus according to the Second Embodiment of the present invention.

In this embodiment, the control circuit 13 shown in FIG. 9 determines a value of DC voltage to be applied during the discharge current control from the amount of absolute humidity read by the ambience sensor 15. FIG. 11 is a graph showing a relationship between the absolute humidity read by the ambient sensor 15 and the value of DC voltage applied to the charge roller during the discharge current control. Here, the applied DC voltage value may desirably be close to the surface potential of the photosensitive drum immediately before the charge roller at an amount of absolute humidity in each environment.

More specifically, in the printer of this embodiment, as shown in FIG. 11, the DC voltage is applied to the charge roller 2 within ±100 V of the surface potential of the photosensitive drum immediately before the charge roller. For example, in the case of the absolute humidity of 5 (g/m$^3$) in FIG. 11, it is preferable that the value of DC voltage applied to the charge roller 2 during the discharge current control is in a range of −125 V and −325 V (center value: −225 V).

Accordingly, the printer of this embodiment is capable of preventing the contamination of the charge roller 2 with the transfer residual toner and unevenness in contamination during the discharge current control by feeding back the absolute humidity in each environment to the value of DC voltage applied to the charge roller 2 during the discharge current control even in the case where the environment is considerably changed.

Further, the printer of this embodiment is capable of considerably prolong the life of the charge roller 2 and effecting stable discharge current control, thus also always causing a constant amount of discharge required in each environment without causing excessive discharge.

Accordingly, the printer of this embodiment is capable of preventing the contamination of the charge roller with the transfer residual toner and unevenness in contamination during the discharge current control by feeding back the absolute humidity in each environment to the value of DC voltage applied to the charge roller during the discharge current control even in the case where the environment is considerably changed.

Further, the printer of this embodiment is capable of considerably prolong the life of the charge roller and effecting stable discharge current control, thus also always causing a constant amount of discharge required in each environment without causing excessive discharge.

Accordingly, the printer of this embodiment is capable of stably maintain a high-quality image for a long period of term without causing melt-sticking of toner onto the photosensitive drum surface.

(Printer of Third Embodiment)

The surface potential of the photosensitive drum 1 immediately before the charge roller 2 is changed under the influence of a total number of sheets of recording material subjected to image formation on the photosensitive drum 1. On the other hand, as described above, the surface potential of the photosensitive drum 1 immediately before the charge roller 2 is the estimate potential. For this reason, the surface potential of the photosensitive drum 1 immediately before the charge roller 2 may preferably estimated in view of the total number of sheets.

The printer of this embodiment is configured to estimate the surface potential of the photosensitive drum 1 immediately before the charge roller 2 in view of the humidity in the total number of sheets to adjust the voltage applied to the charge roller 2.

Figure 12:
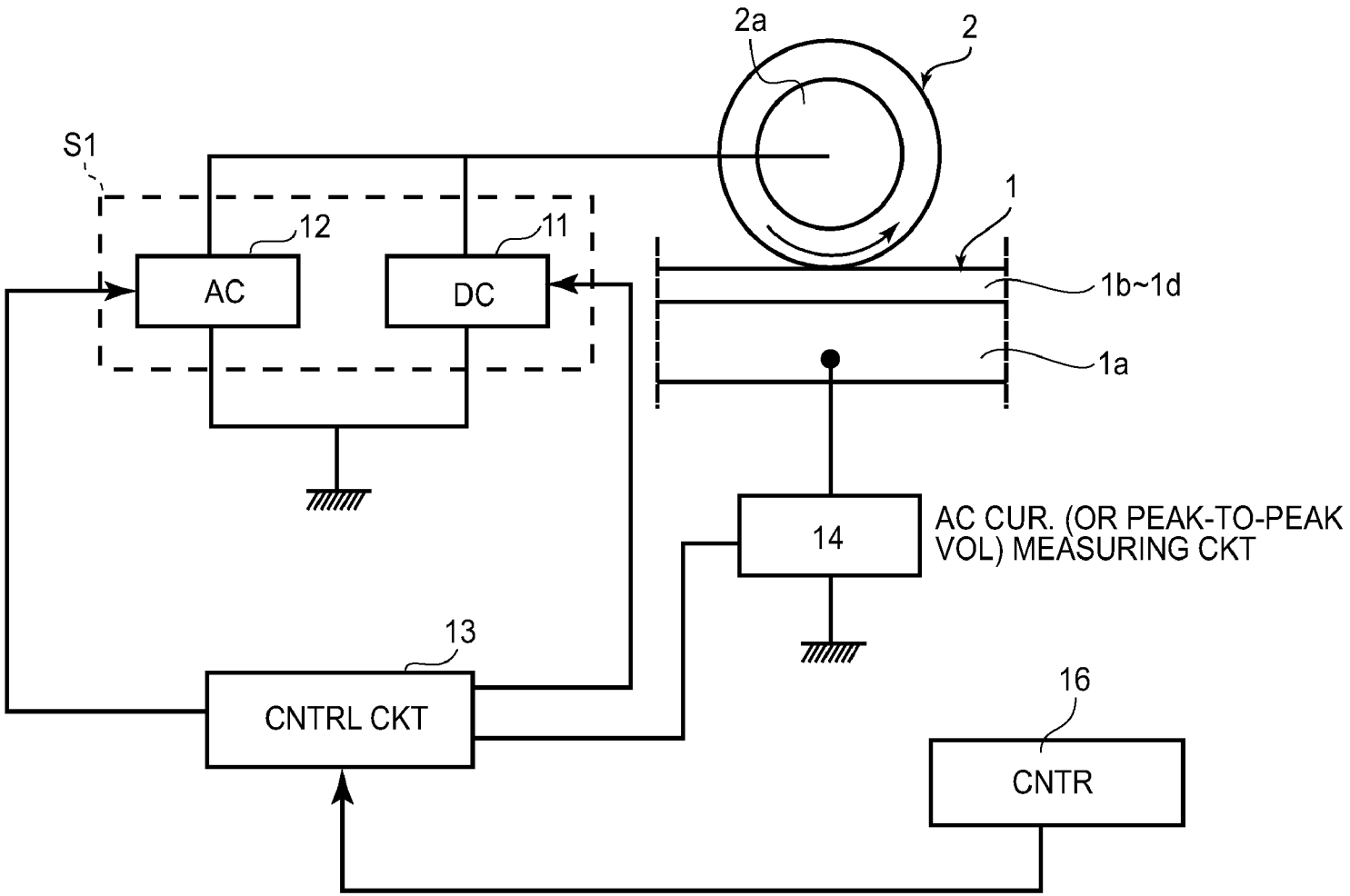
FIG. 12 is a block circuit diagram showing a charge bias application system of the image forming apparatus according to a Third Embodiment of the present invention.

For this purpose, as shown in FIG. 12, the printer of this embodiment further includes a counter 16 for counting the total number of sheets of recording material subjected to image formation on the photosensitive drum 1 in addition to the circuit view of the printer shown in FIG. 4 in the First Embodiment. Other members or portions are the same as those in the First Embodiment, thus being omitted from illustration and explanation.

Counting information of the counter 16 is inputted into the control circuit 13. Further, the control circuit 13 has a function of executing the operation/determination program of an appropriate peak-to-peak voltage value of AC voltage applied to the charge roller 2 in a charging step of a printing step on the basis of AC current value information inputted from the AC current value measurement circuit 14 and the counting information of the counter 16.

Figure 13:
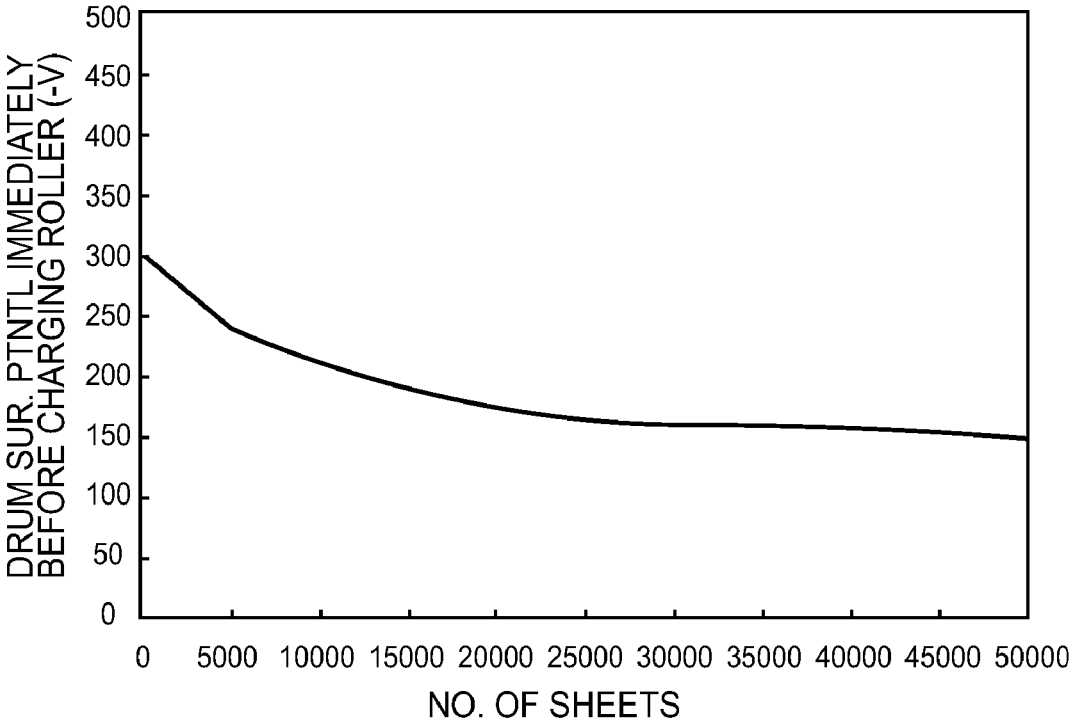
FIG. 13 is a graph showing a relationship between a total number of sheets (subjected to image formation) and a surface potential of the photosensitive drum immediately before the charge roller in the image forming apparatus according to the Third Embodiment of the present invention.

FIG. 13 is a graph showing a relationship between the surface potential of the photosensitive drum immediately before the charge roller and the total number of sheets (printed sheets) when a voltage of +300 V is applied to the auxiliary charging member 7 and a voltage of −800 V is applied to the transfer residual toner charging member 8 in an environment of an absolute humidity of 9 (g/m$^3$). When the total number of sheets is increased, the auxiliary charging member 7 and the transfer residual toner charging member 8 are contaminated with external additive liberated from the transfer residual toner to increase their electric resistances, so that an amount of current flowing from the auxiliary charging member 7 and the transfer residual toner charging member 8 into the photosensitive drum 1.

Figure 14:
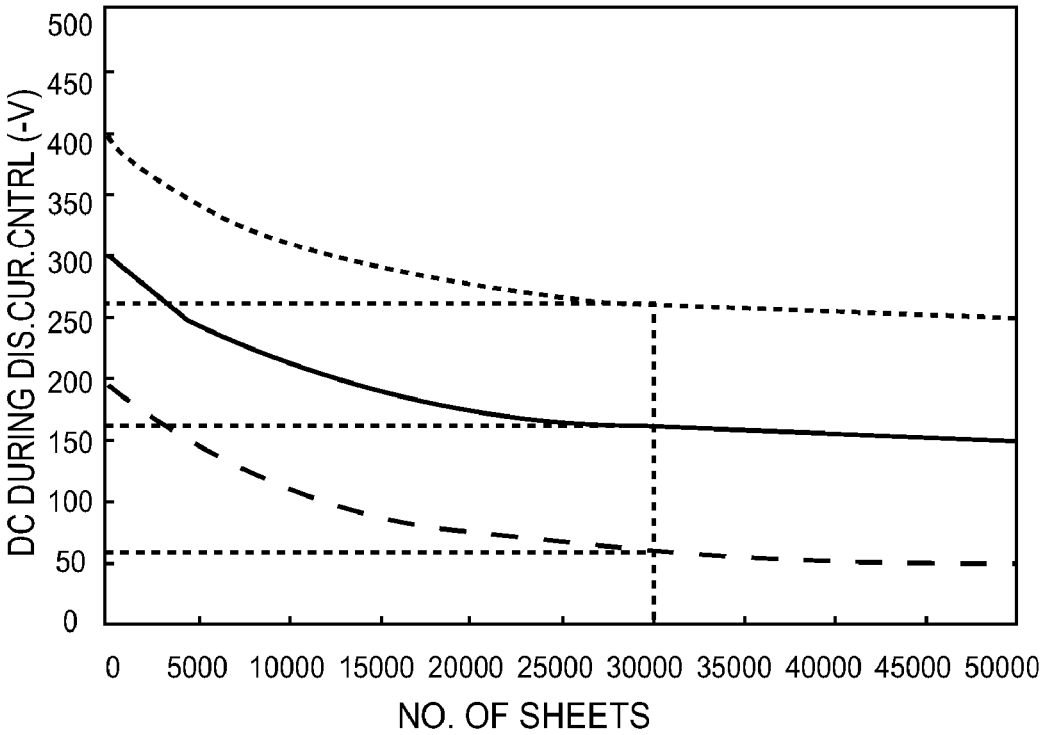
FIG. 14 is a graph showing a relationship between a total number of sheets (subjected to image formation) and an applied DC voltage during discharge current control in the image forming apparatus according to the Third Embodiment of the present invention.

In this embodiment, the control circuit 13 shown in FIG. 12 of the printer of this embodiment controls the DC power source 11 based on the total number of (printed) sheets counted by the counter 16 to determine a value of DC voltage to be applied during the discharge current control. FIG. 14 is a graph showing a relationship between total number of (printed) sheets of recording material counted by the counter 16 and the value of DC voltage applied to the charge roller during the discharge current control. Here, the applied DC voltage value may desirably be as close as possible to the surface potential of the photosensitive drum immediately before the charge roller depending on the total number of sheets.

For this reason, in the printer of this embodiment, as shown in FIG. 14, the DC voltage is applied to the charge roller within ±100 V of the surface potential of the photosensitive drum immediately before the charge roller. For example, in the case of the total number of sheets of 30,000 sheets in FIG. 14, it is preferable that the value of DC voltage applied to the charge roller during the discharge current control is in a range of −60 V and −260 V (center value: −160 V).

As described above, the printer of this embodiment is capable of feeding back the total number of sheets to the value of DC voltage applied to the charge roller 2 during the discharge current control.

For this reason, the printer of this embodiment is capable of preventing the contamination of the charge roller 2 with the transfer residual toner and unevenness in contamination during the discharge current control even in the case where the total number of sheets is increased to change electric resistances of the auxiliary charging member 7 and the transfer residual toner charging member 8.

Further, the printer of this embodiment is capable of considerably prolong the life of the charge roller 2 and effecting stable discharge current control, thus causing a constant amount of discharge without causing excessive discharge. As a result, the printer of this embodiment is capable of stably maintain a high-quality image for a long period of term with no problem such as melt-sticking of toner onto the photosensitive drum surface.

(Printers of other embodiments)

In the above described embodiments, the potential of the photosensitive drum immediately before the image bearing member charging member is estimated but may also be directly measured by additionally providing a potential detection member for measuring the potential of the photosensitive drum immediately before the image bearing member charging member. In this case, it is possible to achieve the same effect as those in the above-described embodiments.

The printer according to the present invention may also be a combination of those in Second Embodiment and Third Embodiment described above. More specifically, the absolute humidity and the total number of sheets of recording material subjected to image formation may also be fed back to the applied DC voltage value during the discharge current control.

In the cleaner-less type printer, there is a case where the AC current value is measured and a thickness of the photosensitive drum is detected from the measured AC current value by an unshown thickness detection portion. Also in this case, by applying to the charge roller 2 a DC voltage having a value close to the surface potential of the photosensitive drum immediately before the charge roller 2, it is possible to effectively prevent contamination of the charge roller during the thickness detection and accurately effect the thickness detection of the photosensitive drum.

In the respective printers described above, the auxiliary charging member 7 and the transfer residual toner charging member 7 are the brush-like member but may also be any shaped members such as a brush-like rotation member, an elastic roller member, a sheet-like member, etc.

The photosensitive drum 1 in each of the above-described printers may also be of direct injection charging type in which a charge injection layer having a surface resistivity of $10^{9}$-$10^{14}$ ohm.cm is provided. Further, even in the case where the charge injection layer is not provided, a similar effect can be achieved, e.g., when a charge transport layer has the above described surface resistivity. Further, the photosensitive drum 1 in each of the above described printers may also be an amorphous silicon photosensitive member having a volume resistance of about $10^{13}$ ohm.cm at a surface layer thereof.

In the above-described printers, the charge roller is used as the flexible contact charging member but the same effect as in the present invention can also be obtained by using a fur brush or a charging blade.

As a waveform for the AC voltage component (AC component or a voltage having a periodically changed voltage value) of the oscillating electric field applied to the charge roller 2 or the developing sleeve 4*b*, it is also possible to appropriately use sinusoidal wave, rectangular wave, triangular wave, etc. Further, it is also possible to use such a rectangular wave that it is creased by periodically turning the DC power source on and off.

Further, in the printers described above, the exposing device (information writing portion) is the laser scanning type exposing device but may also be of, e.g., a digital exposure type using a solid-state light emitting device such as LED. Further, the exposing device may also be an analog exposing device using a halogen lamp or a fluorescent lamp as an original illumination light source.

In the printers described above, the photosensitive drum is used as the image bearing member but the image bearing member may also be an electrostatic recording dielectric member. In this case, the surface of the electrostatic recording dielectric member is once electrically charged uniformly and thereafter the charged surface is required to be subjected to selective charge removal with charge-removing means such as a charge-removing needle head or electron gun so that an electrostatic latent image corresponding to objective image information can be written and formed.

Further, in the above-described printers, the roller transfer using the transfer roller as the transfer device. However, the transfer method may also be other contact transfer charging methods using a blade transfer and a belt transfer or a non-contact transfer charging method using corona discharger.

Further, the above-described printers and the image forming apparatus in which the toner image of single color formed on the photosensitive drum is directly transferred onto the recording material but may also be an image forming apparatus in which the toner image of single color is formed by using an intermediary transfer member as transfer means such as a transfer drum or a transfer belt. Further, the printers may also be image forming apparatuses for forming a multi-color image or a full-color image by employing multiple transfer or the like. The present invention is applicable to all the image forming apparatuses described above.

As described hereinabove, according to the present invention, during the discharge current control, it is possible to reduce the amount of toner from the photosensitive member electrically charged to the normal polarity to the image bearing member charging member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 265419/2005 filed Sep. 13, 2005, which is hereby incorporated by reference.

What is claimed is:

1. An image forming apparatus, comprising:

a photosensitive member;

a charging member configured to electrically charge said photosensitive member at a charging position to form an electrostatic image on said photosensitive member;

a charging bias applier configured to apply an AC voltage superposed with a DC voltage to said charging member to charge said photosensitive member;

a developing device configured to develop the electrostatic image on said photosensitive member with toner to form a toner image;

a developing bias applier configured to apply a developing bias to said developing device to develop the electrostatic image;

a toner charging member configured to electrically charge a residual toner on said photosensitive member, after the toner image on said photosensitive member is transferred and before said photosensitive member is charged by said charging member, to collect the residual toner on said developing device;

a toner charging bias applier configured to apply a DC voltage having a same polarity as a regular charge polarity of the toner to charge the residual toner;

a detector configured to detect an AC current flowing through said charging member by applying an AC voltage to said charging member when an area of which said photosensitive member is charged by said toner charging member passes through the charging position; and a setting device configured to set the AC voltage applied to said charging member by said charging bias applier during an image formation based on an output of said detector, wherein said charging bias applier applies a DC voltage within ± 100V of a potential of the area of said photosensitive member, when the area of said photosensitive member passes through the charging position.

2. An apparatus according to claim 1, wherein an absolute value of the DC voltage applied to said toner charging member by said toner charging bias applier is larger than an absolute value of the DC voltage applied to said charging member by said charging bias applier during image formation.

3. An apparatus according to claim 1, wherein an absolute value of a DC voltage of the developing bias during an operation of detecting the AC current is smaller than that of a DC voltage of the developing bias during image formation.

4. An apparatus according to claim 1, further comprising a humidity detector configured to detect atmosphere humidity, wherein said charging bias applier variably controls the DC voltage applied to said charging member based on an output of said humidity detector when the area of said photosensitive member passes through the charging position.

5. An apparatus according to claim 1, further comprising a counter configured to count a number of image formations, wherein said charging bias applier variably controls the DC voltage applied to said charging member based on an output of said counter when the area of said photosensitive member passes through the charging position.

* * * * *